US008991737B2

(12) United States Patent
Leppä et al.

(10) Patent No.: US 8,991,737 B2
(45) Date of Patent: Mar. 31, 2015

(54) METHOD AND APPARATUS FOR DECELERATING A MACHINE REEL OF AN UNWINDER

(75) Inventors: Ari Leppä, Espoo (FI); Jukka Gruzdaitis, Vantaa (FI)

(73) Assignee: ABB Oy, Helsinki (FI)

( * ) Notice: Subject to any disclaimer, the term of this patent is extended or adjusted under 35 U.S.C. 154(b) by 1322 days.

(21) Appl. No.: 12/686,131

(22) Filed: Jan. 12, 2010

(65) Prior Publication Data

US 2010/0181412 A1 Jul. 22, 2010

(30) Foreign Application Priority Data

Jan. 12, 2009 (FI) ..... 20095020

(51) Int. Cl.
*B65H 59/38* (2006.01)
*B65H 26/02* (2006.01)

(52) U.S. Cl.
CPC ..... *B65H 26/025* (2013.01); *B65H 2513/11* (2013.01); *B65H 2515/116* (2013.01); *B65H 2515/322* (2013.01)
USPC ..... 242/421.4; 242/420.5

(58) Field of Classification Search
CPC .... B65H 23/185; B65H 23/188; B65H 59/38; H02P 3/14; H02P 3/18; H02P 3/22; B41F 13/016; B41F 33/12
USPC ..... 242/413, 412, 412.1, 413.1, 413.3, 242/413.4, 413.5, 417, 420, 420.5, 421, 242/421.1, 421.4, 421.5, 418.1, 525
See application file for complete search history.

(56) References Cited

U.S. PATENT DOCUMENTS 3,822,838 A * 7/1974 Butler et al. ..... 242/417.2
3,928,844 A * 12/1975 Meihofer ..... 226/11
3,977,621 A 8/1976 Huffman
4,186,309 A * 1/1980 Gnuechtel ..... 250/559.43

(Continued)

FOREIGN PATENT DOCUMENTS

DE 296 04-401 5/1996
FR 1 587 426 3/1970

(Continued)

OTHER PUBLICATIONS

Finnish Search Report dated Sep. 7, 2009, issued in the corresponding Finnish Patent Application No. 20095020.

(Continued)

*Primary Examiner* — William A Rivera
(74) *Attorney, Agent, or Firm* — Buchanan Ingersoll & Rooney PC

(57) ABSTRACT

A method and apparatus are provided for decelerating an inverter-controlled machine reel in a paper machine. The method includes detecting a break in a paper web from a machine reel, determining the inertia of the machine reel, determining continuously the angular speed of the machine reel, and determining continuously the torque required to decelerate the machine reel, on the basis of the determined inertia and angular speed, for the purpose of stopping the machine reel in a predefined time. The method also includes decelerating the machine reel electrically to stop the machine reel, in accordance with the determined torque, and using a mechanical brake when the rotation speed of the machine reel is lower than a predefined rotation speed and when the torque obtained by electrical deceleration is too small to stop the machine reel in a predefined time.

17 Claims, 3 Drawing Sheets

(56) References Cited

U.S. PATENT DOCUMENTS

| | | | | |
|---|---|---|---|---|
| 4,280,081 | A * | 7/1981 | Dinger et al. | 318/6 |
| 4,852,785 | A * | 8/1989 | Bettendorf et al. | 226/42 |
| 5,503,349 | A | 4/1996 | Chertok | |
| 5,791,541 | A * | 8/1998 | Jitsuishi et al. | 226/40 |
| 6,464,163 | B1 | 10/2002 | Kinnunen et al. | |
| 6,577,483 | B1 * | 6/2003 | Steicher et al. | 361/90 |
| 7,344,105 | B2 * | 3/2008 | Lindsey | 242/534 |
| 7,398,943 | B2 * | 7/2008 | Horneck et al. | 242/534 |
| 7,455,259 | B2 * | 11/2008 | Koutonen et al. | 242/541 |
| 8,026,681 | B2 * | 9/2011 | Alexander et al. | 318/376 |
| 2002/0008173 | A1 | 1/2002 | Burri et al. | |
| 2004/0182965 | A1 | 9/2004 | Fuchs et al. | |
| 2005/0242224 | A1 | 11/2005 | Shiraishi et al. | |
| 2006/0006271 | A1 | 1/2006 | Fuchs et al. | |
| 2008/0150459 | A1 * | 6/2008 | Alexander et al. | 318/376 |
| 2010/0106301 | A1 | 4/2010 | Leppä et al. | |

FOREIGN PATENT DOCUMENTS

| | | | |
|---|---|---|---|
| WO | 00/23365 | A1 | 4/2000 |
| WO | WO 2008/096034 | | 8/2008 |

OTHER PUBLICATIONS

European Search Report dated Nov. 22, 2010, issued in the corresponding European Application No. 10150399.3-1256.

Opposition filed against corresponding European Patent Application No. 2 206 667 B1 on Dec. 5, 2012.

* cited by examiner

METHOD AND APPARATUS FOR DECELERATING A MACHINE REEL OF AN UNWINDER

RELATED APPLICATIONS

This application claims priority under 35 U.S.C. §119 to Finnish Patent Application No. 20095020 filed in Finland on Jan. 12, 2009, the entire content of which is hereby incorporated by reference in its entirety.

FIELD

The present disclosure relates to decelerating a machine reel of an unwinder, and more particularly, to decelerating a machine reel in unwinders of post-processing machines in the paper industry.

BACKGROUND INFORMATION

When making a continuous material web, such as paper on a paper machine, for example, the material finished by the machine and rolled onto a reel is often processed with post-processing machines. Examples of such post-processing machines related to the post-processing of paper include various off-line calenders, winders, and rewinders. Common features of these post-processing machines are that the material is unwound with an unwinder, processed in a desired manner, and rewound with a rewinder.

Increasing the speeds of paper machines and corresponding machines producing a continuous material web also produces pressure to increase the speeds of the post-processing devices and to minimize shutdown times. One problematic point in post-processing devices is associated with the operation of unwinders during a material web break. The situation is especially pronounced in winders that make customized reels, that is, smaller reels ordered by the customer, from machine reels. On a machine reel, the paper or corresponding material has the width of the production machine, and the width is cut into customer-specified narrower and smaller reels by using a winder.

Several customized reels are typically obtained from one machine reel, in other words, the unwinder of the winder needs to be stopped several times during one machine reel to remove the finished customized reels and to start new ones. Even though the winder speeds are great, the releases of customized reels from them slow the average speed. If a malfunction stopping the operation of the winder occurs, the winder may become a part that contributes to slowing down of the production of the paper mill.

One issue in post-processing devices is associated with stopping the machine reel of an unwinder during a web break. Material is unwound from the unwinder at great speed, and in a normal situation, the material is wound with a rewinder after processing. If the material web breaks between the unwinder and rewinder, the material will unwind on the floor of the mill hall. A significant amount of material unwinding at great speed accumulates quickly on the floor, and before the restart of production, this material must be collected from the floor. When a web break is detected, the unwinder is stopped as quickly as possible to minimize the break time and material loss.

Stopping unwinders during web break situations is achieved in accordance with the prior art by using a mechanical brake at its full capacity. In addition, a motor is used for decelerating when the deceleration torque exceeds the capacity of the mechanical brake. The deceleration torque provided by the motor is limited in such a manner that the total deceleration torque does not exceed the limits of the system mechanics. A mechanical brake is obligatory equipment defined by standards, with which a machine reel in an unwinder is made to remain unrotational, and the machine reel may be stopped in a specific time.

An issue with the mechanical brake is stopping the unwinder at high rotation speeds, in particular. The mechanical brake decelerates at a fixed deceleration torque, so at high rotation speeds the power used in deceleration easily damages the mechanical brake and makes it unusable. The mechanical brake also cannot be adjusted in a simple manner so that deceleration power could be increased or decreased during deceleration. Thus, a web break may cause a long shutdown, when the brakes of the unwinder become unusable during one deceleration.

In deceleration, mechanical brakes transform the energy bound to the machine reel into heat that heats the brakes. This heating of the brakes may also cause a fire hazard, as the material releases uncontrollably from the unwinder, whereby dry paper or the like may come into contact with the heated brakes.

SUMMARY

An exemplary embodiment provides a method for decelerating a machine reel in a paper machine. The exemplary method comprises detecting a break in a paper web from the machine reel, determining an inertia of the machine reel, and determining continuously an angular speed of the machine reel. In addition, the exemplary method comprises determining continuously the torque required to decelerate the machine reel, on the basis of the determined inertia and angular speed, for the purpose of stopping the machine reel in a predefined time. The exemplary method also comprises decelerating the machine reel electrically in accordance with the determined torque to stop the machine reel. Furthermore, the exemplary method comprises stopping the machine reel via a mechanical break, when a rotation speed of the machine reel is lower than a predefined rotation speed and when the torque achieved by electrical deceleration is too low to stop the machine reel in the predefined time.

Another exemplary embodiment provides an apparatus for decelerating a machine reel in a paper machine. The exemplary apparatus comprises a mechanical brake configured to decelerate the machine reel. The exemplary apparatus also comprises means for detecting a break in a paper web from the machine reel, means for determining an inertia of the machine reel, and means for continuously determining an angular speed of the machine reel. In addition, the exemplary apparatus comprises means for determining the torque required to decelerate the machine reel, on the basis of the determined inertia and angular speed, for the purpose of stopping the machine reel in a predefined time, and means for decelerating the machine reel electrically in accordance with the determined torque to stop the machine reel. Furthermore, the exemplary apparatus comprises means for stopping the machine reel via the mechanical brake, when a rotation speed of the machine reel is lower than a predefined rotation speed and when the torque achieved by electrical deceleration is too small to stop the machine reel in the predefined time.

An exemplary embodiment provides a computer-readable recording medium having a computer program recorded thereon that causes a computer to execute operations comprising: detecting a break in a paper web from a machine reel; determining an inertia of the machine reel; determining continuously an angular speed of the machine reel; determining continuously a torque required to decelerate the machine reel, on the basis of the determined inertia and angular speed, for the purpose of stopping the machine reel in a predefined time; generating a signal for decelerating the machine reel electrically in accordance with the determined torque to stop the machine reel; and generating a signal for using the mechanical brake to stop the machine reel, when a rotation speed of the machine reel is lower than a predefined rotation speed and when the torque achieved by electrical deceleration is too small to stop the machine reel in the predefined time.

BRIEF DESCRIPTION OF THE DRAWINGS

Additional refinements, advantages and features of the present disclosure are described in more detail below with reference to exemplary embodiments illustrated in the drawing, in which.

DETAILED DESCRIPTION

Exemplary embodiments of the present disclosure provide a method and an apparatus implementing the method in such a manner that the above-mentioned problems are solved.

Exemplary embodiments of the present disclosure are based on replacing as extensively as possible the deceleration done with mechanical brakes by a motor deceleration and on using the mechanical brake when necessary only at speeds that are lower than a given speed rate. The inertia and rotation speed of the machine reel or the like in the unwinder is continuously known, so the deceleration torque required to stop the reel in a required time may be calculated. In a corresponding manner, the obtained deceleration torque depending on the operating situation of the motor may also be calculated, if necessary.

Exemplary embodiments of the present disclosure provide an advantageous feature in that the deceleration situation is easier to control, because the deceleration torque provided with a motor may be adjusted as necessary. In addition exemplary embodiments of the present the disclosure provide improved energy utilisation, because the energy stored in the rotating mechanical system may be returned to the supplying network through a frequency converter, for example.

Further, because the mechanical brakes are not loaded as much as in the known deceleration method, the problems related to the wear and heating of the mechanical brakes are diminished, and thus the capacity of the device where the unwinder resides increases due to a reduction in the number of maintenance services. Thanks to the mechanical brakes that do not heat up so much, fire safety also improves.

Figure 1:
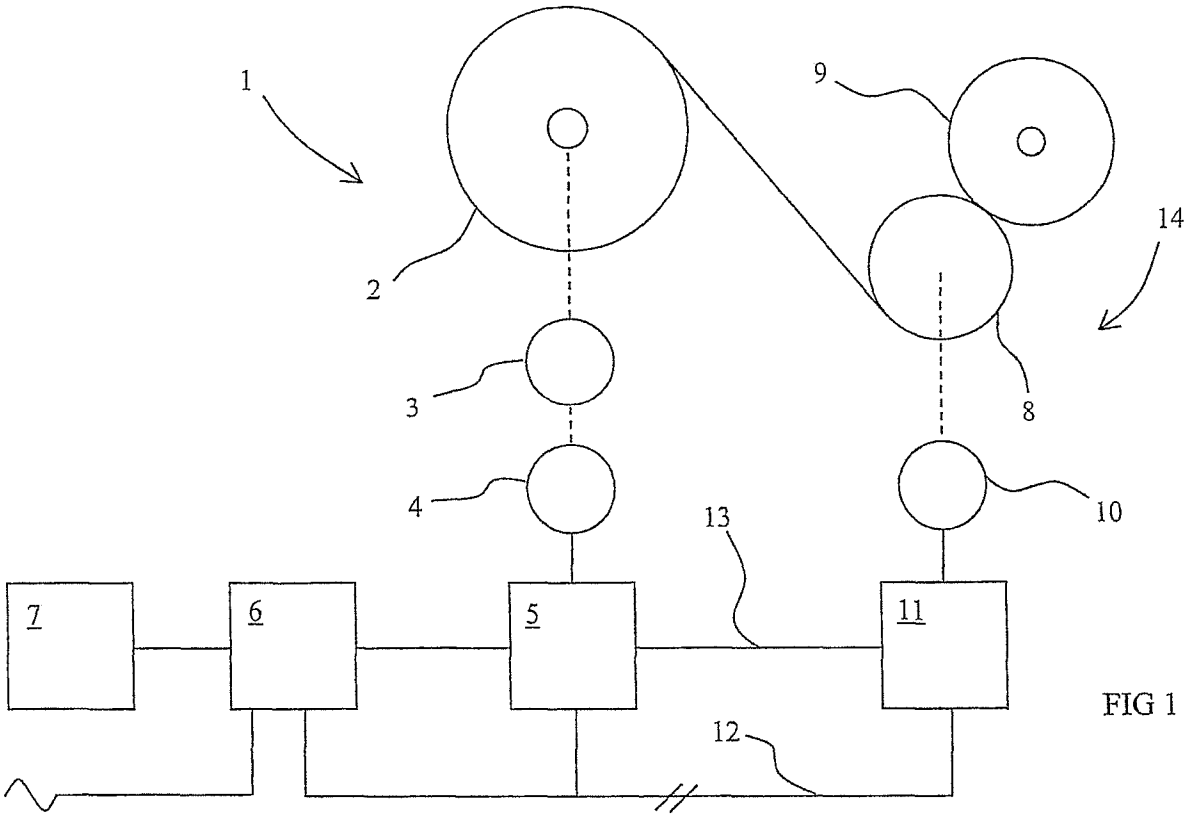
FIG. 1 shows an example of the general principle of an electric drive in connection with a paper post-processing machine.

FIG. 1 shows the principle of an electric drive in connection with a post-processing machine related to papermaking. This post-processing machine is shown only in connection with the electric drive in such a manner that only the parts of the post-processing machine that are related to features of the describing the present disclosure are shown.

FIG. 1 shows in particular an unwinder 1, in which a machine reel 2 obtained from a paper machine is placed. A motor 4 and mechanical brake 3 are fastened to the axle of the machine reel 2. The motor 4 is controlled by an inverter 5 that receives its operating power supply from a direct-current (DC) busbar system 12. A feed unit 6 generates direct current to this direct-current busbar system 12 from the alternating current (AC) of the supply network.

Further, FIG. 1 shows a rewinder 14 that, in connection with winders, forms customized reels 9 from the paper on a machine reel. In the rewinder 14, the paper web turns around a drive roll 8 on to the customized reel 9. The drive roll 8 is controlled by a motor 10 whose operating power is supplied by an inverter 11. In FIG. 1, both inverters 5, 11 are shown as coupled to the same direct-current supply 12. The feed unit 6 together with the inverters 5, 11 forms one supply group in FIG. 1. FIG. 1 also shows a control system 7 that is connected via a data bus to both the feed unit 6 and both inverters 5, 11. The control system 7 provides control information to the inverters 5, 11, which control the respective motors 4, 10 on the basis of the control information to provide the required web speed and paper web tightness, for instance.

Figure 2:
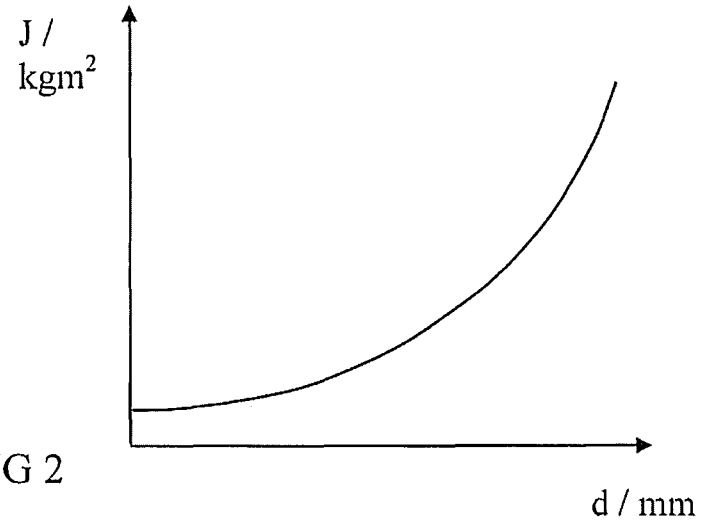
FIG. 2 is a graphical representation of the machine reel inertia as a function of the diameter of the machine reel.

The inertia of the machine reel 2 is, if so desired, continuously known to the control system 7 or immediately calculable. The inertia (J) may be calculated with the following equation (1):

$$J = \pi \rho l \frac{(d^4 - d_{min}^4)}{32} + J_{roll} \tag{1}$$

wherein ρ is the density of the paper on the reel, I is the width of the paper web, d is the diameter of the machine reel 2, $d_{min}$ is the diameter of the drive roll 8, and $J_{roll}$ is the inertia of the drive roll 8. FIG. 2 shows a curve that depicts the change in the inertia of the machine reel 2 as a function of the diameter of the machine reel 2. As shown by the diagram in FIG. 2, the inertia of the machine reel 2 increases exponentially as the diameter of the machine reel 2 increases. The diameter of the machine reel 2 is determined continuously either on the basis of the amount and thickness of paper on the machine reel 2 or by physically measuring the size of the machine reel 2 with an automated measuring apparatus or by calculation.

The rotation speed (n) of the motor 4 turning the machine reel 2 is, in turn, dependent on the web speed (v) and diameter (d) of the machine reel 2 in accordance with the following equation (2):

$$n = \frac{v}{\pi d} i \tag{2}$$

wherein the coefficient i depends on the gear ratio between the possibly used motor 10 and drive roll 8. The web speed is typically held constant, such that as the diameter of the machine reel 2 decreases, the rotation speed of the machine reel 2 increases correspondingly.

The deceleration torque that is required for stopping the machine reel 2 in time t from angular speed ω may be calculated with the following equation (3):

$$T_{break} = J\frac{d\omega}{dt}. \quad (3)$$

Figure 3:
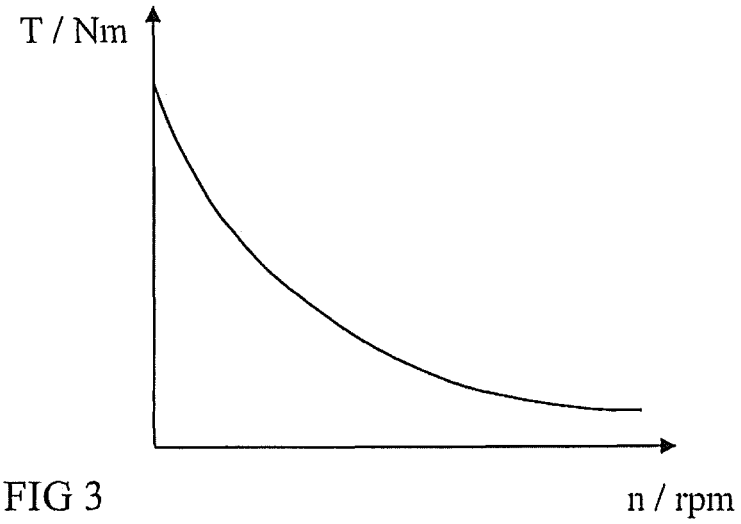
FIG. 3 is a graphical representation of the required deceleration torque as a function of the rotation speed of the machine reel.

The deceleration torque required for the stopping the machine reel 2 is directly proportional to the angular speed ω and inertia J of the machine reel 2 and, as earlier mentioned, the inertia J diminishes strongly as the diameter of the machine reel 2 decreases. FIG. 3 shows the magnitude of the torque required for deceleration as a function of the rotation speed n of the motor 4 turning the machine reel 2 when assuming that the web speed and deceleration time are constant. FIG. 3 shows how the deceleration torque required for stopping the machine reel 2 diminishes as the rotation speed n increases, that is, when the inertia is higher, the torque required for stopping the machine reel 3 needs to be higher despite the lower rotation speed. As mentioned earlier, for deceleration, the situation is, however, most problematic when the rotation speed n is high, because when decelerating with mechanical brakes, the decelerating force directed to the rotating roll produces a power that is proportional to the rotation speed and the torque produced by the decelerating power. Equations (2) and (3) use the terms angular speed ω and rotation speed n. As is known, the ratio between the angular speed ω and rotation speed n is linear, and the angular speed ω is obtained by multiplying the rotation speed with the constant 2π.

All the above-mentioned measured or calculated quantities are known and available to the control system 7. The rotation system is also capable of performing controls related to other devices than the motors 4, 10. For example, the control system 7 may control the using of the mechanical brake 3 either directly or through a communications connection and another control system.

Exemplary embodiments of the present disclosure provide a method of detecting a break in the paper web exiting an unwinder 1. The break can be detected automatically as the web suddenly becomes loose. According to an exemplary embodiment, the tightness of the web can be adjusted in such a manner that the rewinder 14 is speed-controlled and the unwinder 1 is torque-controlled to obtain a required web tightness. Information on the web tightness can be transmitted from the inverter 5 to the control system 7.

Further, according to exemplary method of the present disclosure, the inertia (J) of the machine reel 2 can be determined. The inertia may be calculated with the above equation (1), and in general, instantaneous inertia (J) is continuously known to the control or adjustment system 7 of the motor. In the exemplary method, it is also possible to use during the entire deceleration the inertia of the instant after the web break. During deceleration, the inertia of the machine reel 2 decreases as the material unwinds. If the inertia of the break instant is used in the method, the drive roll 8 is stopped somewhat quicker than when using the instantaneous inertia that is updated as the machine reel 2 unwinds. According to an exemplary embodiment of the present disclosure, the inertia of the machine reel 2 is continuously calculated during deceleration, whereby the entire deceleration process is thoroughly controlled.

In the exemplary method of the present disclosure, the angular speed (ω) of the machine reel 2 is continuously determined. The determination of the angular speed (ω) may be performed with separate sensors, or the electric drive may determine the angular speed independently on the basis of its internal models. Information on the angular speed is transmitted and/or calculated in the control system 7.

Safety regulations and the like often define the allowed time that may elapse in the stopping of the machine reel 2. This time may be the same time as that used to accelerate the machine reel. When the angular speed and inertia of the machine reel 2 are known, it is possible to use equation (3) to calculate the deceleration torque with which the machine reel 2 may be stopped in the required time. During deceleration, as the rotation speed of the machine reel 2 decreases, equation (3) is used to continuously calculate a new value for the required torque to decelerate and stop the machine reel 2, taking into consideration the already elapsed time from the initial moment of the break or deceleration start.

According to an exemplary embodiment of the present disclosure, the machine reel 2 is decelerated electrically by driving the motor 4 regeneratively. When the motor 4 serves as a generator, power is obtained from the rotating reel 2 and transformed in the motor 4 into electric power that may be supplied to the network, when the feed unit 6 is equipped with a suitable bidirectional network bridge.

Figure 5:
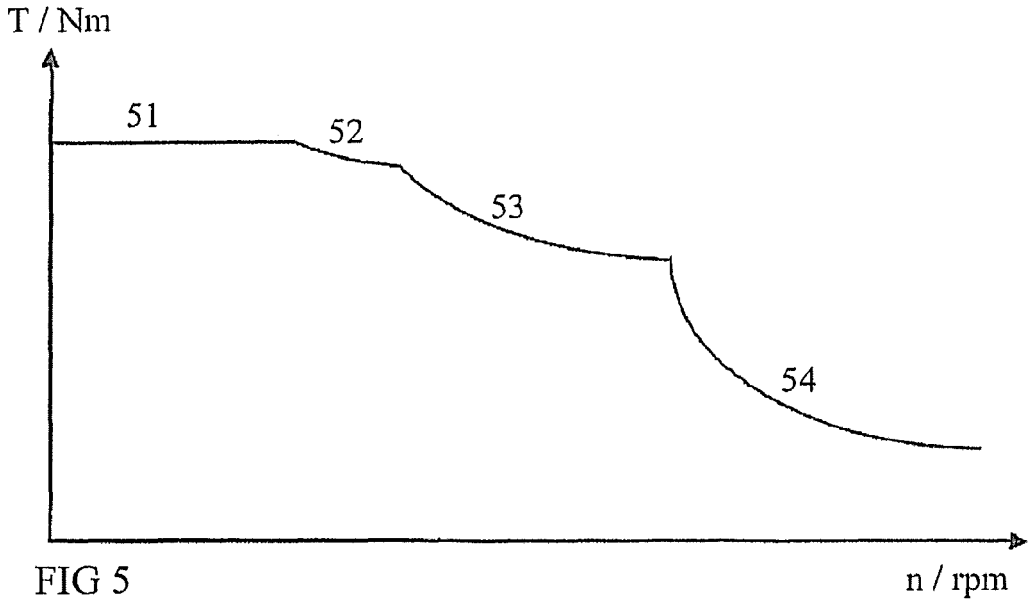
FIG. 5 is an example of the maximum values of the torque used in deceleration as a function of the rotation speed of the machine reel.

When the motor 4 serves as a generator, the deceleration torque produced by it depends on the rotation speed range of the motor 4. FIG. 5 shows the torque to be produced as a function of the rotation speed of the motor 4. As the machine reel 2 rotates at high speed, the torque provided in a field weakening range is limited by a pull-out torque limit 54 of the motor 4. As the speed decreases in the range 53, the torque-limiting factor is the feed unit 6 that defines the maximum power to be transferred to the network which cannot be exceeded. The feed unit 6 is dimensioned for normal drive situations in such a manner that it is sufficient in all normal drive situations. In the structure shown in FIG. 1, it is possible to feed through the feed unit 6 back to the network the power obtained from both the unwinder 1 and rewinder 14 when they are decelerating. The feed unit 6 can have a fixed amount of power transmission capacity reserved for each motor 4, 10. However, as in the case of FIG. 1, the rewinder 14 can be stopped faster than the unwinder 1 due to smaller masses, it is advantageous to transfer the power capacity of the feed unit 6 reserved for the rewinder 14 in a deceleration situation to the unwinder 1, whereby the power limit 53 of FIG. 5 and thus the used deceleration torque may be increased.

As the speed further decreases while the deceleration progresses, the torque is limited by the current limit 52 of the inverter. The inverters are dimensioned for a certain maximum current that is not safe or possible to exceed. Thus, the deceleration torque of the motor 4 should be limited by keeping the current at the allowed maximum value. As the rotation speed decreases, the next area is a torque limit 51, which is the maximum torque that the motor 4 is capable of producing. This maximum torque may be used until the motor 4 and machine reel 2 stop.

The deceleration event described above does not necessarily begin by limiting the torque due to the pull-out torque limit 54. Depending on the rotation speed, the deceleration may be begun in any of the above-mentioned ranges 51-54.

Figure 4:
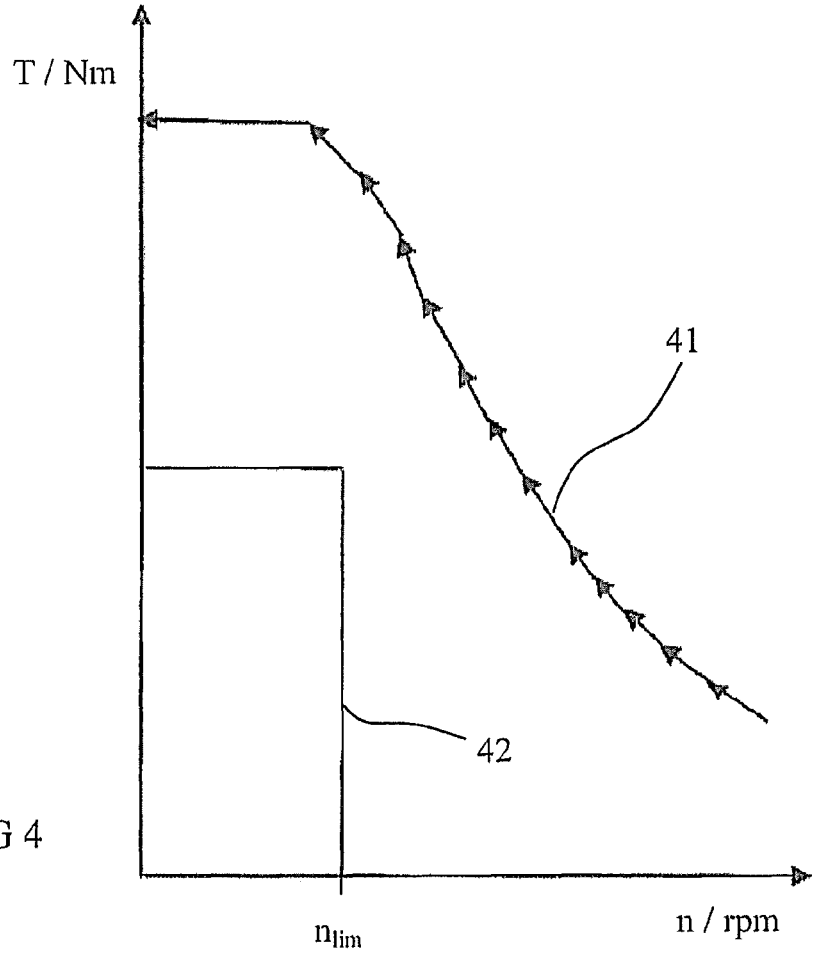
FIG. 4 is a graphical representation of a deceleration manner according to the disclosure.

According to an exemplary embodiment of the present disclosure, the machine reel 2 is decelerated electrically to stop the machine reel 2. FIG. 4 shows an example of the deceleration event and especially of the torque 41 provided by electric deceleration as a function of the rotation speed of the machine reel 2. FIG. 4 shows that as the rotation speed decreases, the deceleration torque is increased in accordance with the above principles.

According to an exemplary embodiment of the present disclosure, a mechanical brake (e.g., mechanical brake 3 illustrated in FIG. 1) can also be used when the rotation speed of the machine reel 2 is lower than a predefined rotation speed $n_{lim}$ and when electrical deceleration alone is not enough to stop the machine reel 2 in a predefined time. FIG. 4 also shows the deceleration torque 42 to be produced with a mechanical brake. The size of the deceleration torque produced at low operating speeds is thus a sum of the mechanical deceleration torque 42 and electrical deceleration torque 41. Introducing the mechanical brake after a certain limiting operating speed prevents the destruction of the brakes due to the excessive power that transforms into heat during deceleration.

When achieving the above-mentioned limit speed $n_{lim}$, the deceleration torque can be defined to be achievable by electric deceleration. If this deceleration torque is sufficient to stop the rotating mass in the required time, there is no need to use the mechanical brake, and all the energy bound to the rotating mass may be transformed into electrical energy. The deceleration torque obtained by electrical deceleration may be defined by calculation at any time, and the magnitude of this deceleration torque depends on the rotation speed, as shown in FIG. 5. It is also possible that immediately as the deceleration starts, the deceleration energy obtained with the motor is defined and this energy is compared with the energy of the rotational movement of the rotating machine reel. It is then possible to determine right at the start of the deceleration, whether the mechanical brake will be needed to decelerate the machine reel. The energy of the machine reel can be calculated from the inertia and angular speed, and the deceleration energy may be defined as a surface area delimited by the curve of FIG. 5 between the speed zero and the web break speed. If the energy of the machine reel is higher than the deceleration energy obtained by electrical deceleration, the mechanical brake should be used. The calculation may be performed by first calculating the stopping time achieved by electrical deceleration, from which deceleration is obtained, and on the basis of this calculation, it is determined whether use of the mechanical brake is appropriate. It is also conceivable that, on the basis of these calculations, the time instant for taking the mechanical brake into use is determined.

When the rotating machine reel has stopped, the mechanical brake is locked. In an apparatus configured to implement the exemplary method of the present disclosure, the deceleration force of the mechanical brake may be reduced in comparison with the earlier force. If the mechanical brake is hydraulic, for instance, the hydraulic pressure may be decreased, because most of the deceleration is done electrically, and the mechanical brake is used at low rotation speeds only or in malfunctions of the electrical network.

According to a exemplary embodiment of the inventive method, the electrical deceleration torque can be limited relative to the maximum value of the mechanics. In other words, the deceleration torque must not be so high as to damage the mechanics of the system. This should also be taken into consideration in a situation where the mechanical brake is taken into use. If the mechanical brake must be taken into use to stop the machine reel in the defined time, it should also be taken into consideration at the same time that the sum of the torque of the electrical and mechanical decelerations should not be higher than the limit set by the mechanics. The torque obtained by electrical deceleration may be adjusted, and because the torque obtained by the mechanical brake is constant and known, the limit set by the mechanics may be taken into consideration by adjusting the torque of the electrical deceleration.

The apparatus of the disclosure comprises means for detecting a break in a paper web from the machine reel, means for continuously determining the inertia of the machine reel, means for continuously determining the angular speed of the machine reel, means for determining the torque required to decelerate the machine reel on the basis of the determined inertia and angular speed to stop the machine reel in a predefined time, means for electrically decelerating the machine reel for the purpose of stopping machine reel, and means for using a mechanical brake when the rotation speed of the machine reel is lower than a predefined rotation speed and when the torque to be obtained by electrical deceleration is too small to stop the machine reel in a predefined time. These means may be implemented as a combination of a control system, feed unit, and inverter, while one of these elements comprises a calculation capacity for performing the required calculations.

The calculation capacity can, for example, reside in the control system that may receive measuring information from the process as well as data produced by the feed unit and inverters. On the basis of this data, the control system calculates controls and produces output signals for performing the deceleration in accordance with the disclosure.

The present disclosure may be implemented in existing systems or by using separate elements and devices in a centralized or distributed manner. Existing devices, such as control systems, can comprise a computer processing device (i.e., computer processor hardware circuitry) and computer-readable recording memory that may be utilized in implementing the functionality of the embodiments of the disclosure. Thus, all alterations and configurations required to implement the embodiments of the disclosure may be performed using a computer processing device that includes a computer processor which executes software routines recorded in a computer-readable recording medium (e.g., ROM, hard disk drive, or other non-volatile and/or volatile memory). If the functionality of the present disclosure is carried out by means of a computer processing device executing a computer program recorded on a computer-readable recording medium, the computer program may be provided as a computer program product that comprises a computer program code, the execution of which in the computer processing device makes the computer or corresponding hardware perform the functionality according to the disclosure as described above. This type of computer program code may be stored on a computer-readable recording medium, such as a suitable storage medium, for instance a flash memory or disk storage, from which it may be read to a unit or units that execute the program code. In addition, this type of program code may be loaded onto a hardware unit or units for execution over a suitable data network, and it may replace or update a possibly existing program code.

The foregoing techniques and aspects of the present disclosure may be implemented in many different ways. The present disclosure and its embodiments are thus not restricted to the examples described above, but may vary within the scope of the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for decelerating a machine reel in a paper machine, the method comprising:

detecting a break in a paper web from the machine reel;

determining an inertia of the machine reel;

determining continuously a rotational speed of the machine reel;

determining continuously the torque required to decelerate the machine reel, on the basis of the determined inertia and the rotational speed, for the purpose of stopping the machine reel in a predefined time;

decelerating the machine reel electrically in accordance with the determined torque to stop the machine reel; and using a mechanical brake to stop the machine reel when a rotation speed of the machine reel is lower than a predefined rotation speed and when the torque achieved by electrical deceleration is too low to stop the machine reel in the predefined time.

2. A method as claimed in claim 1, comprising determining the inertia of the machine reel continuously during deceleration.

3. A method as claimed in claim 2, comprising decelerating the machine reel electrically using the highest possible torque available.

4. A method as claimed in claim 2, comprising determining continuously the magnitude of the deceleration torque obtained by electrical deceleration.

5. A method as claimed in claim 1, comprising decelerating the machine reel electrically using the highest possible torque available.

6. A method as claimed in claim 5, comprising determining continuously the magnitude of the deceleration torque obtained by electrical deceleration.

7. A method as claimed in claim 6, comprising limiting the deceleration torque obtained by electrical deceleration, when an instantaneous deceleration torque exceeds a limit set for a system including the machine reel.

8. A method as claimed in claim 1, comprising determining continuously the magnitude of the deceleration torque obtained by electrical deceleration.

9. A method as claimed in claim 8, comprising limiting the deceleration torque obtained by electrical deceleration, when an instantaneous deceleration torque exceeds a limit set for a system including the machine reel.

10. A method as claimed in claim 8, comprising:

determining, after the paper web from the machine reel has broken, an amount of energy bound to a rotational movement of the machine reel on the basis of the determined rotational speed and inertia of the machine reel;

determining an amount of energy that is obtained by electrical deceleration;

comparing the determined amount of energy obtained by electrical deceleration with the determined amount of energy bound to the rotational movement; and determining when to use a mechanical brake, when the determined amount of energy obtained by electrical deceleration is smaller than the determined energy bound to the rotational movement.

11. A method as claimed in claim 10, comprising determining an amount of time to use the mechanical brake on the basis of the comparison of the energy amounts.

12. A method as claimed in claim 1, comprising:

determining, after the paper web from the machine reel has broken, an amount of energy bound to a rotational movement of the machine reel on the basis of the determined rotational speed and inertia of the machine reel;

determining an amount of energy that is obtained by electrical deceleration;

comparing the determined amount of energy obtained by electrical deceleration with the determined amount of energy bound to the rotational movement; and determining when to use a mechanical brake, when the determined amount of energy obtained by electrical deceleration is smaller than the determined energy bound to the rotational movement.

13. A method as claimed in claim 12, comprising determining an amount of time to use the mechanical brake on the basis of the comparison of the energy amounts.

14. A method as claimed in claim 1, wherein the machine reel is inverter-controlled.

15. An apparatus for decelerating a machine reel in a paper machine, the apparatus comprising a mechanical brake configured to decelerate the machine reel, wherein the apparatus comprises:

means for detecting a break in a paper web from the machine reel;

means for determining an inertia of the machine reel;

means for continuously determining a rotational speed of the machine reel;

means for determining the torque required to decelerate the machine reel, on the basis of the determined inertia and the rotational speed, for the purpose of stopping the machine reel in a predefined time;

means for decelerating the machine reel electrically in accordance with the determined torque to stop the machine reel; and means for stopping the machine reel via the mechanical brake, when a rotation speed of the machine reel is lower than a predefined rotation speed and when the torque achieved by electrical deceleration is too small to stop the machine reel in the predefined time.

16. An apparatus as claimed in claim 15, wherein the machine reel is inverter-controlled.

17. A computer-readable non-transitory recording medium having a computer program recorded thereon that causes a processor arranged as a controller to execute operations comprising:

detecting a break in a paper web from a machine reel based on information transmitted from an inverter;

calculating an inertia of the machine reel;

calculating continuously a rotational speed of the machine reel;

calculating continuously a torque required to decelerate the machine reel, on the basis of the determined inertia and the rotational speed, for the purpose of stopping the machine reel in a predefined time;

generating a signal for controlling a motor for decelerating the machine reel electrically in accordance with the determined torque to stop the machine reel; and generating a signal for controlling a mechanical brake for using the mechanical brake to stop the machine reel, when a rotation speed of the machine reel is lower than a predefined rotation speed and when the torque achieved by electrical deceleration is too small to stop the machine reel in the predefined time.

* * * * *